United States Patent [19]

Yan

[11] Patent Number: 4,909,926

[45] Date of Patent: Mar. 20, 1990

[54] METHOD FOR REMOVING MERCURY FROM HYDROCARBON OIL BY HIGH TEMPERATURE REACTIVE ADSORPTION

[75] Inventor: Tsoung Y. Yan, Philadelphia, Pa.

[73] Assignee: Mobil Oil Corporation, New York, N.Y.

[21] Appl. No.: 304,635

[22] Filed: Feb. 1, 1989

[51] Int. Cl.[4] ..... C10G 29/04

[52] U.S. Cl. ..... 208/253; 55/74; 585/820; 585/826; 208/251 R; 208/299; 208/305; 502/38

[58] Field of Search ..... 208/253, 251 R, 299, 208/305; 55/74; 585/820, 826; 502/38

[56] References Cited

U.S. PATENT DOCUMENTS

| | | | |
|---|---|---|---|
| 3,257,776 | 6/1966 | Park et al. | 55/74 |
| 3,374,608 | 3/1968 | Manes | 55/74 |
| 3,791,963 | 2/1974 | Whilehurst et al. | 208/253 |
| 4,094,777 | 6/1978 | Sugier et al. | 210/670 |
| 4,101,631 | 7/1978 | Ambrosini et al. | 423/210 |
| 4,474,896 | 10/1984 | Chao | 55/74 |

FOREIGN PATENT DOCUMENTS 2310795 6/1979 France .

*Primary Examiner*—Helane Myers

*Attorney, Agent, or Firm*—Alexander J. McKillop; Charles J. Speciale

[57] ABSTRACT

A method is provided for removing mercury from hydrocarbon fluids by high temperature reactive adsorption. A hydrocarbon feed passed through an adsorbent mass including a reactive adsorbent such as silver or copper sulfide on an alumina support. The optimum temperature of the feed to be treated depends upon the 90% boiling points corresponding to heavier feeds. A hydrocarbon condensate feed may be drawn from a stabilizer column in a natural gas processing plant at a temperature in excess of 400° F. If a metallic silver-/alumina adsorbent is employed, the adsorbent may be regenerated through high temperature oxidation. Once oxidation is complete, the temperature is lowered in a reducing or inert atmosphere.

21 Claims, 5 Drawing Sheets

Hg in Effluent VS Bed Volume of Condensate Treated

Hg in Product VS Bed Volume of Condensate Treated

Hg Left in Product VS 1/LHSV

METHOD FOR REMOVING MERCURY FROM HYDROCARBON OIL BY HIGH TEMPERATURE REACTIVE ADSORPTION

BACKGROUND OF THE INVENTION

The field of the invention relates to the removal of mercury from liquid and gaseous fluids, particularly hydrocarbon oils.

Typical crude oils may contain about 0.5 to 10 ppb of mercury. Higher levels of mercury are often found in hydrocarbon condensates from natural gas production. Concentrations between fifty and three hundred parts per billion are present in the condensate from some fields.

High levels of mercury in hydrocarbon liquid, crude oil and condensate can cause problems in processing due to the corrosive effect of mercury on vital equipment such as cryogenic heat exchangers. Such heat exchangers are often made from aluminum which forms an amalgam with mercury. In addition, mercury in hydrocarbon products is released into the air upon combustion and causes environmental concerns.

A number of methods have been developed for removing mercury from gases and liquids. U.S. Pat. Nos. 4,094,777, 4,101,631, 4,419,107 and French Publication No. 2 310 795 disclose several such methods. The '777 patent and the French publication both employ a metal or metal compound supported by an adsorbent mass such as alumina or silica-alumina. The '777 patent teaches the use of copper sulphide within the mass while the French publication indicates that the preferred metals are silver or a mixture of silver with gold, nickel or copper. The French patent also teaches an optimum temperature range between −50° and 200° depending upon the nature of the active metal. The '631 patent discloses a process including passing a mercury-containing gas stream through a sorption zone containing a crystalline zeolitic molecular sieve having elemental sulfur loaded thereon.

The heavy condensate produced from some fields contains about twenty percent of $C_{10}$ and higher hydrocarbons, and five percent of $C_{20}$ and higher hydrocarbons. Typical crudes which often contain mercury are much heavier than the condensate, and can contain up to eighty percent $C_{20}$ and higher hydrocarbons. When adsorbents are used to adsorb mercury directly, the non-selective adsorption of the heavy material competes too favorably with the mercury leading to low mercury adsorption capacity.

SUMMARY OF THE INVENTION

The invention concerns the removal of mercury from liquid and gaseous fluids such as natural gas and hydrocarbon oils.

It is an object of the invention to provide a method for reducing mercury contaminants from hydrocarbon fluids effectively to the low levels required for process equipment and environmental control.

It is another object to provide an environmentally sound process for mercury removal.

Still another object of the invention is to provide a mercury removal process which can be readily integrated into existing processing systems.

In accordance with the above objectives, a method is provided for the selective adsorption of mercury which includes the steps of providing a high surface area support having a reactive adsorbent thereon, passing a mercury-containing fluid into contact with the adsorbent, and maintaining the temperature of the adsorbent within an optimum range, depending upon the feed, to improve the adsorption rate and minimize non-selective adsorption.

In accordance with a preferred embodiment of the invention, the reactive adsorbent is metallic silver and the support is alumina. Silver is a preferred adsorbent as it can be regenerated. The regeneration process includes the initial steps of depressurizing the reactor which is filled with the adsorbent and draining off the feed. Adsorbed oil is purged by increasing the temperature within the reactor to 400°–600° F. A hot gas from a flue gas generator or the like is introduced into the reactor at a temperature between about 700°–850° F.

The amount of oxygen in the gas is limited initially to between about one and five percent by weight. The oxygen content is gradually increased. If no additional burning takes place upon the addition of oxygen, as evidenced by the absence of a temperature increase, combustion is substantially complete. The reactor is then purged with reducing gases such as $CO/CH_4$, methane, ethane or propane or an inert gas such as nitrogen or carbon dioxide to remove oxygen from the system, and the reactor temperature cooled to between 400°–500° F. The lack of oxygen ensures that silver oxide will not form upon the reduction of the temperature to the operating level. The adsorbent is thereby maintained in an active state.

DETAILED DESCRIPTION OF THE INVENTION

The invention is directed to a practical and economical method for reducing the mercury level in hydrocarbon oil to acceptable levels such as 1–20 ppb.

Mercury in hydrocarbon fluids can be reduced to very low levels if a reactive adsorbent is used to react with mercury to form insoluble compounds. In contrast to physical adsorption, it has been found that the rate of reactive adsorption is enhanced by increasing the reaction temperature. High temperatures have been found to not only improve the adsorption rate but also increase the adsorption capacity, in contrast to common wisdom. It has been discovered that at higher temperatures, the non-selective adsorption of heavy hydrocarbons is minimized, and more active sites accordingly remain available on the adsorbent for mercury adsorption. Thus, high temperature adsorption leads to higher levels of mercury removal as well as higher adsorption capacity for the adsorbents. Temperature above 400° F.

are preferred to provide the best efficiency for treating certain hydrocarbon condensates discussed hereinafter.

Figure 4:
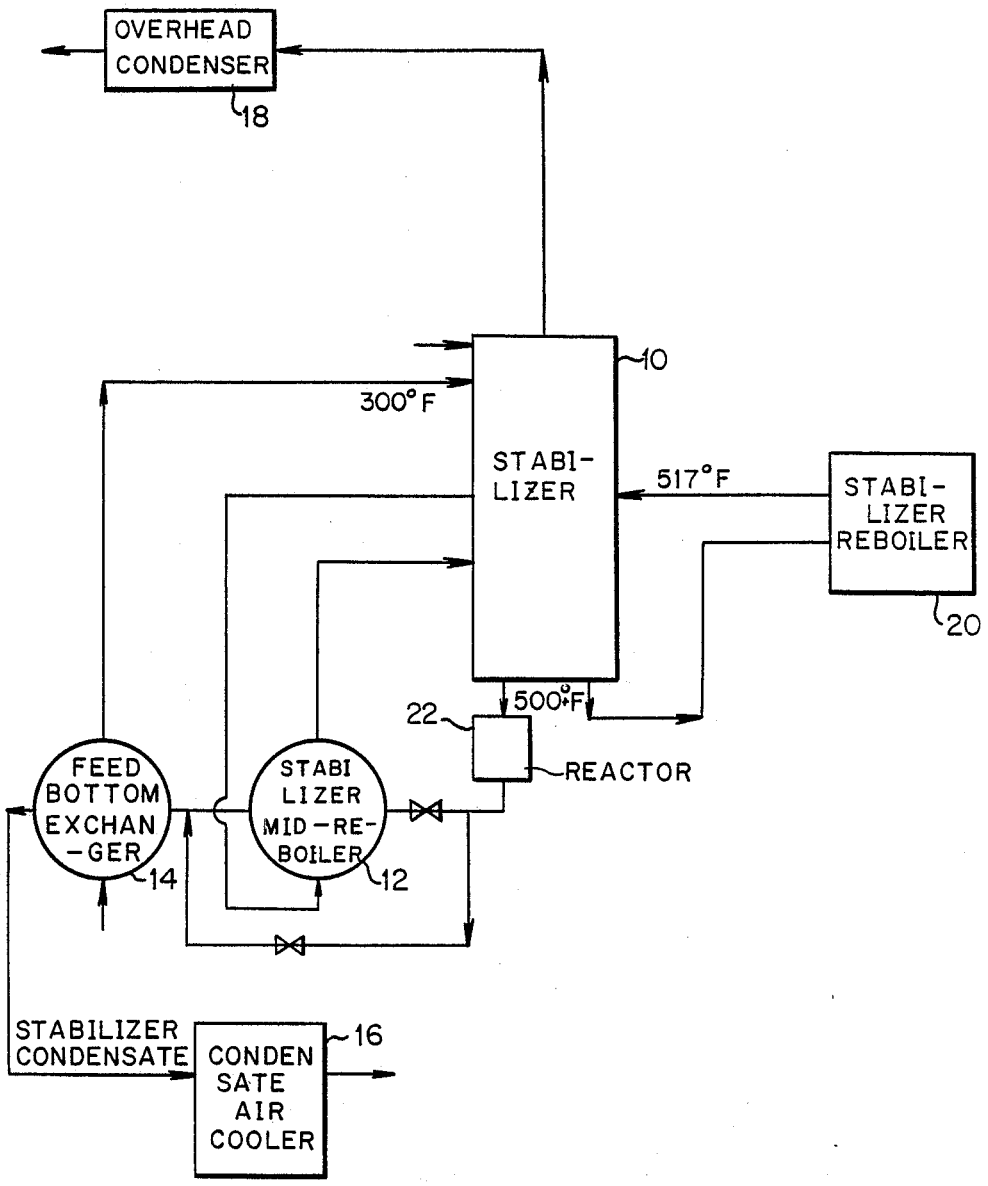
FIG. 4 is a schematic illustration of a portion of a natural gas processing plant.

The process for treating condensate can be advantageously integrated within existing refineries as shown in FIG. 4. The desired temperature and pressure conditions for the process have been found to exist in a stabilizer therein which is located in the process stream before the condensate passes to a heat exchanger. A reactor filled with adsorbent may accordingly be positioned in the flow stream between the stabilizer and heat exchanger.

The reactive adsorbents which may be used in accordance with the invention include Au, Ag, Cu, Sn, and Zn in metallic, oxide and sulfided forms. The reactive adsorbents are supported by a high surface area substrate such as $Al_2O_3$, Si $O_2$, $SiO_2/Al_2O_3$, zeolites (e.g. A, X, Y, ZSM-5, mordanite) and active carbons. The preferred combinations are metallic silver on alumina and CuS on $SiO_2/Al_2O_3$.

Mercury within the hydrocarbon oil is removed by passing it through a reactor filled with adsorbent. The process can be conducted in vapor, vapor/liquid or liquid phase, but homogeneous liquid or vapor phase is preferred to avoid maldistribution of the feed in the adsorption bed. Liquid phase operation is preferred for processing heavy hydrocarbon condensates. The unit pressure is maintained at a high enough level to ensure liquid phase operation at high temperature. A pressure of at least 100 psi is maintained for the processing of liquid condensate. The process may be carried out in the presence of other gases such as light hydrocarbon carbons ($C_1$–$C_6$), $H_2$, $H_2S$, $N_2$, $H_2O$, $CO_2$ and mixtures thereof.

EXAMPLES 1–8

Referring to Tables 1 and 2 below, tests were conducted to determine the effect of temperature (Table 1) and various other parameters (Table 2) for reactive adsorption. The adsorbents were crushed into 40×60 mesh size and 0.25 or 0.50 cc of the crushed adsorbent was filled into a stainless steel tubing of one quarter inch outside diameter and 0.035 inches in wall thickness. A heavy hydrocarbon condensate containing 220 ppb of Hg was pumped through the adsorbent by positive displacement pump at the specified LHSV (liquid hourly space velocity) and temperature. The products were collected for analyses. No apparent differences in chemical and physical properties between the feeds and the respective products were found with the exception of mercury contents.

Figure 1:
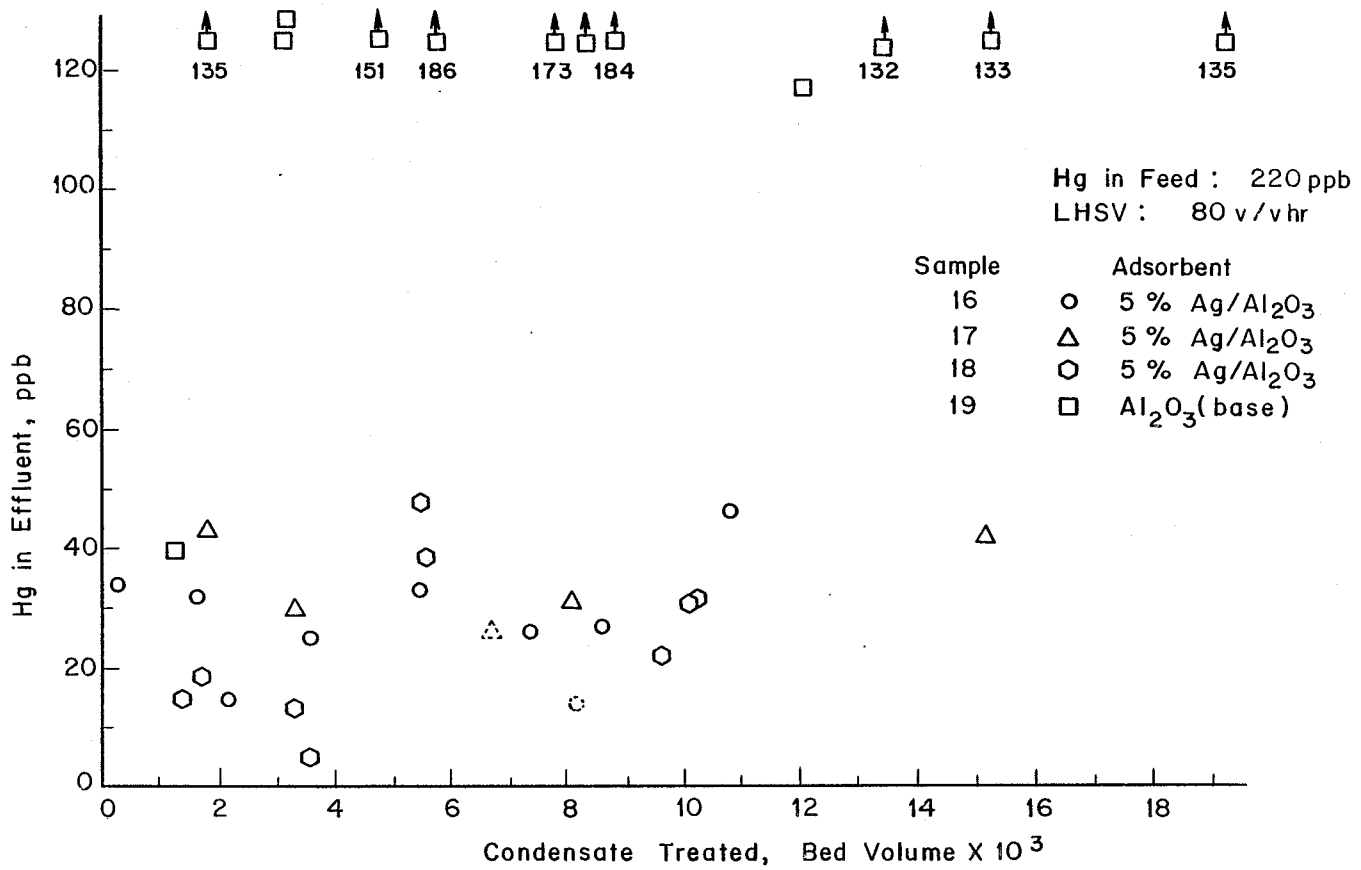
FIG. 1 is a graph illustrating the effectiveness of a 5% $Ag/Al_2O_3$ adsorbent for removing mercury from condensate.

As shown in FIG. 1, mercury removal increases with temperature which therefore indicates that a reactive adsorption involving a chemical reaction takes place rather than simple physisorption. For the particular feed tested, there is very little mercury removal at 75° F. Mercury removal becomes significant at 200° F. and very good at 400° F.

TABLE 1

Effect of Temperature on Reactive Adsorption

Feed: Hydrocarbon condensate, API gravity: 53°; Saturates: 52.1%; $C_{10}^+$: 20%; $C_{20}^+$: 5% 220 ppb Hg;
LHSV: 80 V/Vhr
Adsorbent: $CuS/Al_2O_3$ (extrudate)

| Sample | Temp °F. | Bed Volume No. | Hg in Prod. ppb | Hg Removal % |
|---|---|---|---|---|
| 1 | 75 | 232 | 210 | 4.5 |
| 2 | 75 | 272 | 171 | 22.3 |

TABLE 1-continued

Effect of Temperature on Reactive Adsorption

Feed: Hydrocarbon condensate, API gravity: 53°; Saturates: 52.1%; $C_{10}^+$: 20%; $C_{20}^+$: 5% 220 ppb Hg;
LHSV: 80 V/Vhr
Adsorbent: $CuS/Al_2O_3$ (extrudate)

| Sample | Temp °F. | Bed Volume No. | Hg in Prod. ppb | Hg Removal % |
|---|---|---|---|---|
| 3 | 200 | 432 | 66 | 70.0 |
| 4 | 200 | 1,872 | 92 | 58.2 |
| 5 | 300 | 2,024 | 28 | 87.3 |
| 6 | 300 | 2,190 | 32 | 85.5 |
| 7 | 300 | 2,344 | 31 | 85.9 |
| 8 | 400 | 2,424 | 23 | 89.5 |

EXAMPLES 9–15

When an appropriate adsorbent is used, reactive adsorption at temperatures exceeding 400° F. is effective for removing mercury from heavy condensate to a level of 1–20 ppb depending on the LHSV. The effectiveness of several different adsorbents at various LHSV rates is shown in Table 2.

TABLE 2

High Temperature Reactive Adsorption of Hg

Feed: Hydrocarbon condensate, 220 ppb Hg
Temp: 450° F.
LHSV: Varied

| Sample | Adsorbent | LHSV v/vhr | B.V. (1) No. | Hg in Prod. ppb | Hg Removal % |
|---|---|---|---|---|---|
| 9 | $CuS/Al_2O_3$ | 10 | 2,840 | 3 | 98.6 |
| 10 | $CuS/Al_2O_3$ | 80 | 10,464 | 51 | 76.8 |
| 11 | $Fe/Al_2O_3$ | 80 | 5,480 | 124 | 43.6 |
| 12 | $CuO/ZnO/Al_2O_3$ (sulfided) | 80 | 5,660 | 22 | 90.0 |
| 13 | $Ag/Al_2O_3$ | 40 | 1,862 | 12 | 94.5 |
| 14 | $Ag/Al_2O_3$ | 80 | 1,740 | 19 | 91.4 |
| 14 | $CuO/Al_2O_3$ | 80 | 2,272 | 14 | 93.6 |

(1) Number of bed volume of condensates treated.

As indicated above, using $CuS/Al_2O_3$ and a feed rate of 10 LHSV, 98.6% of the mercury was removed. Rates of 5–10 LHSV appear to be preferable for commercial operations. If adsorption is performed at 10 LHSV, the adsorbent required for a 100,000 barrel/day plant should be about 2,350 cubic feet in volume and fifty tons in weight. Of the adsorbents tested, only $Fe/Al_2O_3$ demonstrated inadequate adsorption capability.

EXAMPLES 16–24

A hydrocarbon condensate having the same properties listed in Table 1, except for mercury content, was tested. The mercury content was increased to 800–2500 ppb by dissolving additional amounts of metallic mercury to speed up the test of mercury loading capacity of the adsorbent.

Three adsorbents were tested: $CuS/Al_2O_3$ in extrudate form, 5% $Ag/Al_2O_3$ in bead form, and 3.5% $Ag/Al_2O_3$ in the form of a trilobe extrudate. CuS can be made by sulfiding CuO with $H_2S$.

A ¼ inch stainless steel tube of 0.049 inch wall thickness was packed with either 0.25 or 0.5 cc of the adsorbents of 40×60 mesh size. In later runs, tube wall thickness was reduced t 0.035 inch and adsorbent size was increased to 18×40 meshes to reduce the problem of reactor plugging. The condensate was pumped using a positive displacement pump. Flow through the adsorbent bed was maintained at the desired reaction temperature of 450° F. The reactor pressure was controlled by use of an externally adjustable relief valve. The products were collected and analyzed for Hg. Except for Hg content, there was no apparent difference in the chemical and physical properties between the feed and the product.

Both types of adsorbents tested were found to be effective. As shown in FIG. 1, the alumina bar itself contributes to mercury removal. At 80 LHSV and 450° F., the mercury in the product treated by the base was about 140 ppb, which represents about 36% removal. The $Ag/Al_2O_3$ adsorbent reduces the mercury to the 30 ppb level for an 86% removal under similar conditions.

Figure 2:
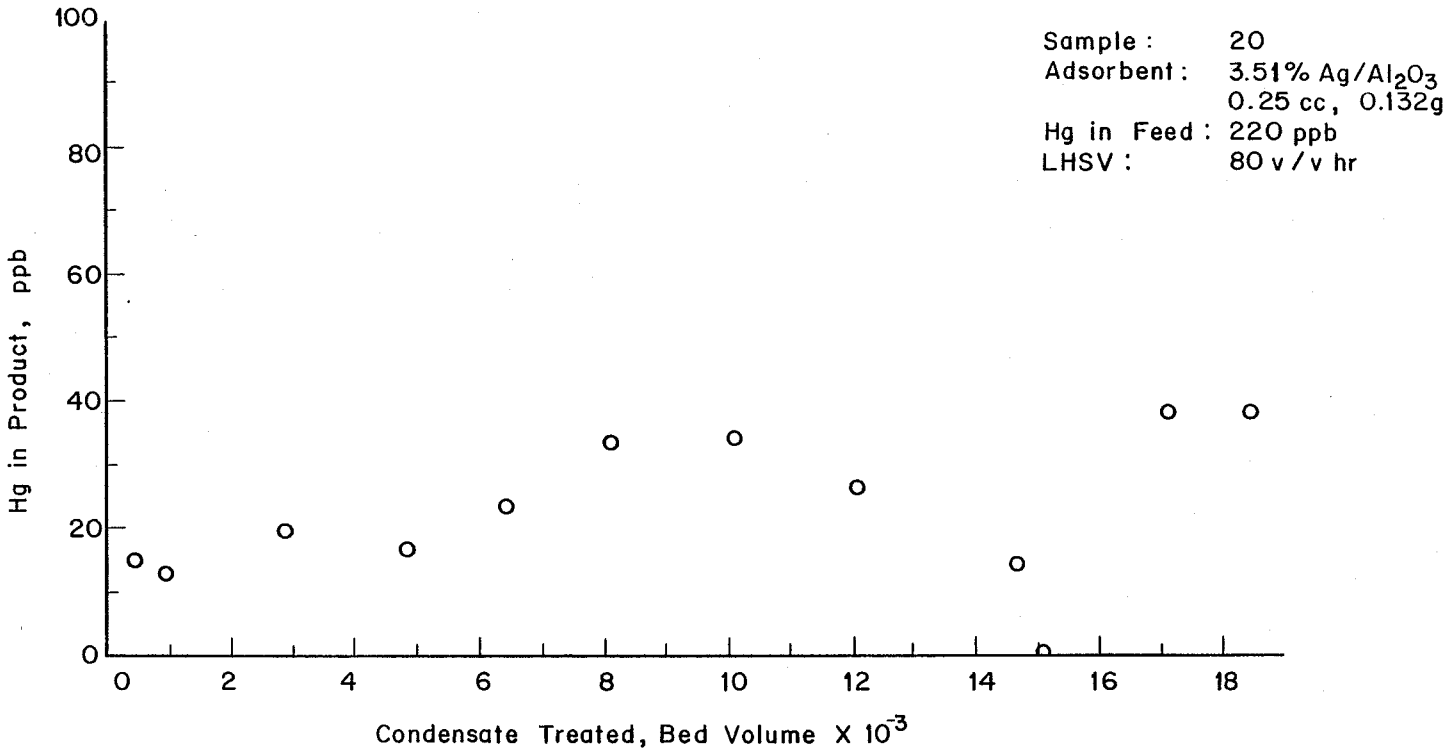
FIG. 2 is a graph illustrating the mercury remaining in condensate as a function of the bed volume of condensate treated.

FIG. 2 illustrates the test results using the 3.5% $Ag/Al_2O_3$ adsorbent. The pressure drop through a bed of this adsorbent is likely to be lower due to its trilobe configuration.

Figure 3:
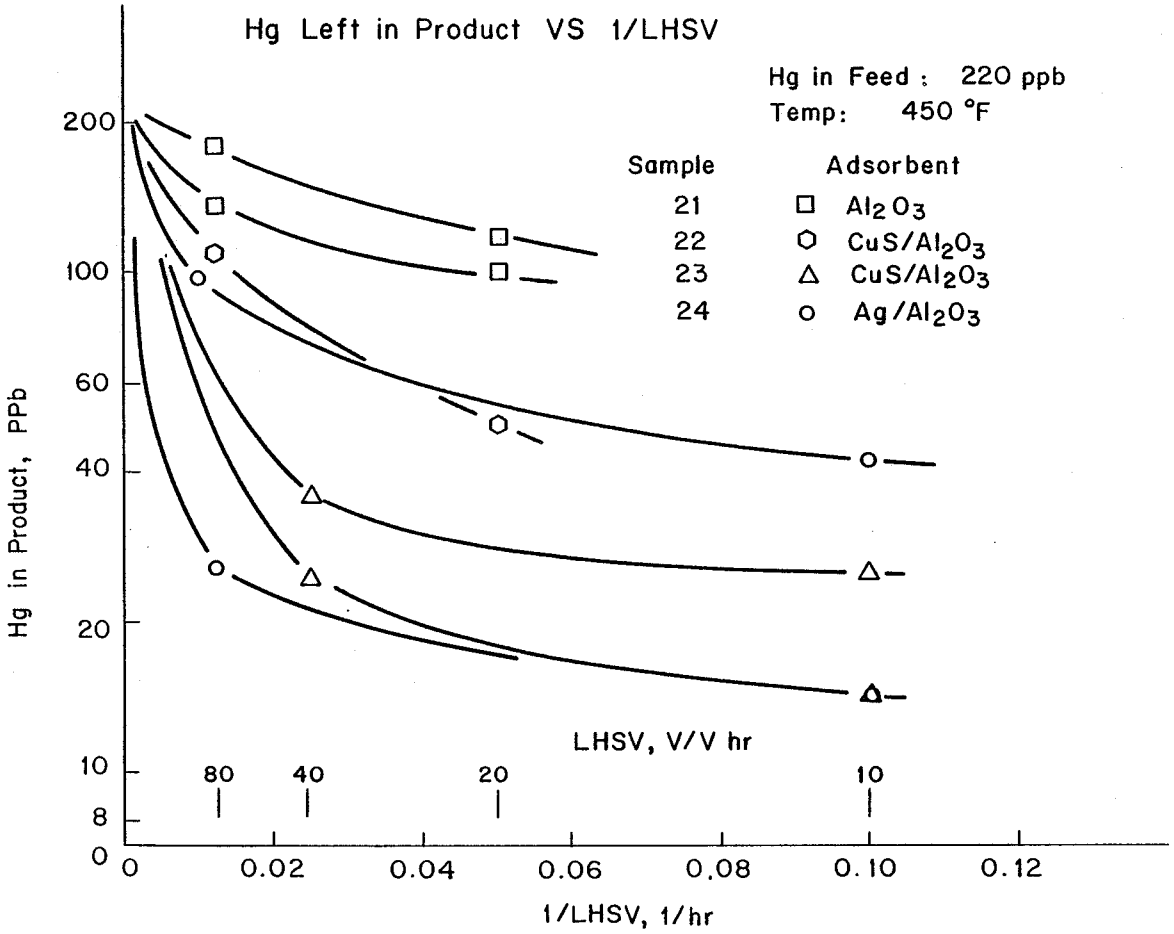
FIG. 3 is a graph illustrating the effectiveness of several different adsorbents for removing mercury from condensate.

The kinetics of mercury removal using both $Ag/Al_2O_3$ and $CuS/Al_2O_3$ do not follow the simple first order with respect to mercury concentration, as shown in FIG. 3. Mercury removal is rapid upon initial contact with the bed and slows down as the LHSV is increased. Improvement in mercury removal has been found to be limited when the LHSV is reduced from eighty to ten.

In commercial natural gas processing plants, natural gas condensates are stabilized by processing in a stabilizer column, which is also referred to as a stabilizer. Hydrocarbon liquid from gas flash drums is routed to the stabilizer where light hydrocarbons are removed by heating, rectification, and stripping.

As shown in FIG. 4, heavy condensate is the bottom product of such stabilizers, and leaves the stabilizer 10 at temperatures about 500° F. and at about 270 psi. The condensate passes through a stabilizer mid-reboiler 12, a feed bottom exchanger 14, and is finally cooled by an air cooler 16 before storage. An overhead condenser 18 is in fluid communication with the top of the stabilizer 10. A stabilizer reboiler 20 reintroduces condensate to the stabilizer 10 at about 517° F. As discussed above, a reactor 22 filled with a suitable adsorbent, preferably $Ag/Al_2O_3$, can be placed near the outlet of the stabilizer. The heavy condensate is passed over the adsorbent in the reactor without any additional temperature or pressure control.

Regeneration of the $Ag/Al_2O_3$ absorber is preferably accomplished by raising the temperature thereof significantly in the presence of oxygen, and purging the oxygen prior to reducing the temperature to the operating range of about 400° F.–500° F. Conventional techniques involving heating the adsorbent in the presence of light hydrocarbons or steam is not particularly effective in that some of the adsorbed hydrocarbons are simply converted to coke.

The regeneration procedure is commenced by depressurizing the reactor and draining the material fed thereto from the stabilizer. Adsorbed oil is then purged off at about 400°–600° F. A hot flue gas is introduced to the reactor at a temperature between about 700°–850° F. The oxygen content of the hot gas should be relatively low, i.e, less than five percent and preferably between about 1–2%. Since combustion of the hydrocarbons within the adsorbent mass tends to occur in zones, care should be exercised to ensure that the temperatures in the "hot" zones do not exceed 940° F. The amount of oxygen in the hot gas is gradually increased to between two and ten percent, depending upon the amount of coke that may remain in the adsorbent. The oxygen content may eventually be raised to greater than ten percent to determine whether combustion has been completed. If such levels do not produce a temperature wise, the purging process is at least substantially complete. While maintaining the temperature in the high range, the oxygen is purged from the reactor by introducing hot nitrogen or methane (400°–700° F.) into the reactor for at least one hour. This prevents the formation of silver oxide when the reactor is cooled to the 400°–500° F. operating range. Silver oxide does not tend to form at the high temperatures used for combustion in the regeneration process.

While the specific examples discussed above have all been directed to the processing of condensate, the operating parameters can be varied to trap mercury within hydrocarbon feeds containing more or less heavy hydrocarbons than the condensate tested.

The optimum treating (reactor) temperature increases with the molecular weight or boiling point of the heaviest portion of the feed. This is because it is this fraction which most successfully competes with mercury for adsorption, thereby destroying the activity of the adsorbent for mercury removed.

Figure 5:
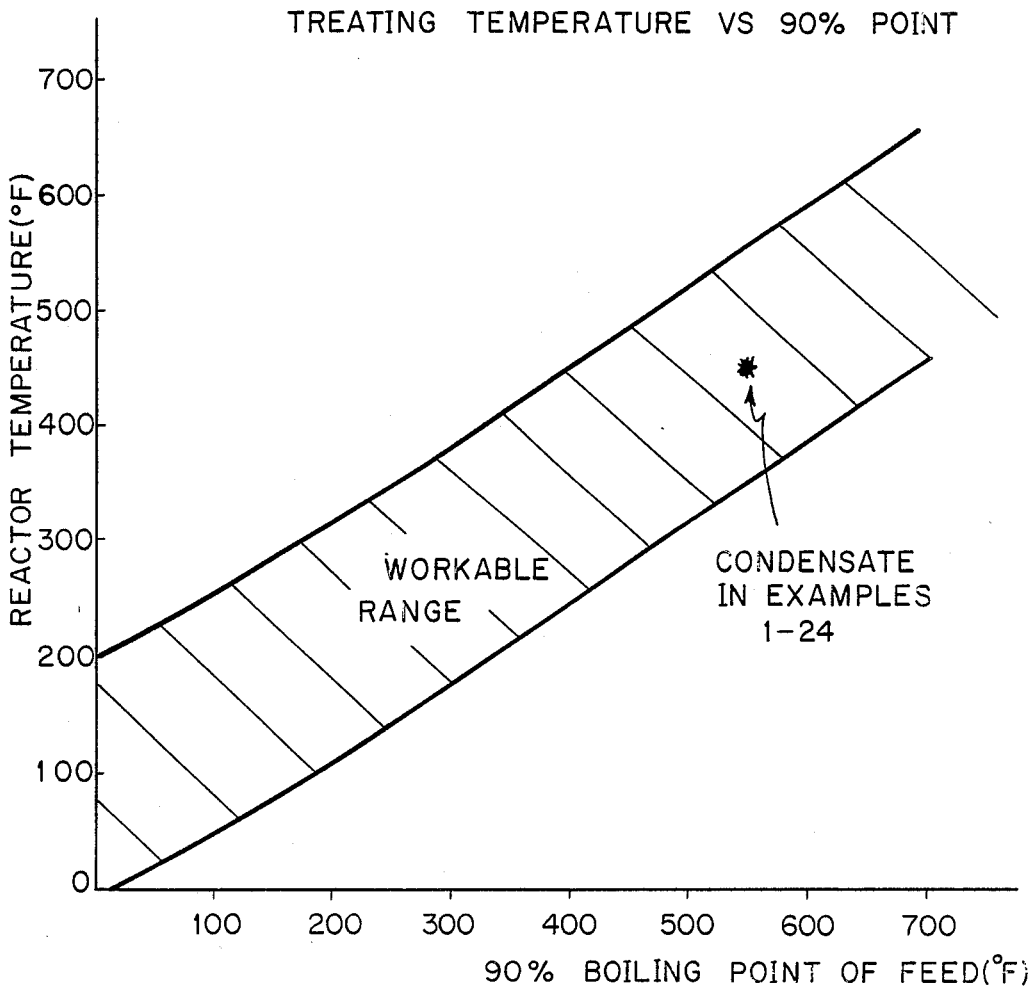
FIG. 5 is a graph illustrating the preferred operating temperature range as a function of the boiling point of the feed.

FIG. 5 illustrates the above-mentioned preferred temperature ranges as a function of the boiling point of the feed at which 90% thereof boils off. This boiling point is related to heaviness of the feed, the higher boiling points being associated with the heavier feeds. The operable range is defined by the area between the two parallel lines, the optimum temperatures being about i the center of the range, plus or minus about 50° F. The optimum temperature for the condensate employed in examples 1–24 is designated by the indicated point in the figure.

The preferred reactor temperature range (T) can be determined approximately (within plus or minus 50° F.) by applying the equation:

$$T(^\circ\text{ F.}) = 0.64\,(BP) + 100^\circ\text{ F.}$$

where BP is the 90% boiling point of the feed in degrees Fahrenheit. The center line in FIG. 5 generally follows the slope defined by the above equation. The operable range is within about 100° F. of this center line.

Pressure is controlled to assure single phase operation regardless of the feed. For hydrocarbon oils such as heavy condensate or crude oil, liquid phase operation is preferred. For light gases such as $C_1$, $C_2$, $C_3$ and their mixtures, gas phase operation is preferred.

What is claimed is:

1. A method for removing mercury present in a hydrocarbon fluid comprising:

providing a support having a high surface area and a reactive adsorbent thereon, said reactive absorbent being reactive to mercury; and contacting said support with said mercury-containing hydrocarbon fluid feed at a temperature defined by the following equation:

$$T(^\circ\text{ F.}) = 0.64\,(BP) + 100^\circ\text{ F.} \pm 100^\circ\text{ F.},$$

where T is said temperature and BP is the boiling point at which 90% of said hydrocarbon fluid feed boils off.

2. A method as defined in claim 1 wherein said reactive adsorbent is selected from the group consisting of Ag, Au, CuO, and CuS.

3. A method as defined in claim 1 wherein said reactive adsorbent is metallic silver and said support is alumina.

4. A method as defined in claim 1 wherein said reactive adsorbent is CuS and said support is $SiO_2/Al_2O_3$.

5. A method as defined in claim 1 wherein said hydrocarbon feed is hydrocarbon condensate in liquid form.

6. A method as defined in claim 5 including the step of feeding said hydrocarbon condensate to said support at a rate of about 5–20 LHSV.

7. A method as defined in claim 1 wherein said hydrocarbon fluid feed is a liquid having a boiling point at which about ninety percent thereof boils off at temperatures between 400° and 600° F., said temperature of said liquid being maintained between 400° and 600° F., said liquid being subjected to sufficient pressure to maintain it in the liquid state.

8. A method as defined in claim 3 including the step of regenerating said silver.

9. A method as defined in claim 8 wherein said silver is regenerated by contacting said support with a hot, oxygen-containing gas having a temperature of at least about 750° F., purging said oxygen within said gas for at least one hour, and lowering said temperature of said support once said oxygen has been purged.

10. A method as defined in claim 9 including the step of purging said oxygen-containing gas with a reducing gas.

11. A method as defined in claim 9 including the step of purging said oxygen-containing gas with an inert gas.

12. A method as defined in claim 9 including the step of raising the oxygen content of said hot gas to between 2–10 weight percent thereof prior to purging said oxygen.

13. A method as defined in claim 1 wherein T (° F.)=0.64 (BP) +100° F. ±50° F.

14. A method as defined in claim 1 wherein said temperature is at least 400° F.

15. A method as defined in claim 1 including the step of sulfiding said reactive adsorbent by contacting it with a sulfur-containing compound.

16. A method of processing mercury-containing hydrocarbon condensate comprising:

stabilizing said condensate in a stabilizer, thereby separating heavy condensate from the remainder of said condensate;

drawing said heavy condensate from said stabilizer at a temperature exceeding 400° F. and a pressure exceeding 100 psi;

passing said heavy condensate through a reactor containing a bed of mercury adsorbent material, said adsorbent material including high surface area support material and a mercury reactive adsorbent supported thereon, said bed removing a substantial portion of any mercury which may be contained within said heavy condensate; and passing said heavy condensate from said reactor to a cooler.

17. A method as defined in claim 16 wherein said temperature is about 400° F.–600° F.

18. A method as defined in claim 16 wherein said reactive adsorbent is selected from the group consisting of Ag, Au, CuO, and CuS.

19. A method as defined in claim 16 wherein said reactive adsorbent is metallic silver and said support material is alumina.

20. A method as defined in claim 16 wherein said reactive adsorbent is CuS and said support material is $SiO_2/Al_2O_3$.

21. A method as defined in claim 1 wherein said reactive adsorbent is active carbon.

* * * * *